US011493189B2

(12) United States Patent
Farmer et al.

(10) Patent No.: US 11,493,189 B2
(45) Date of Patent: Nov. 8, 2022

(54) APPARATUS PROVIDING BEAMFORMING AND ENVIRONMENTAL PROTECTION FOR LED LIGHT SOURCES

(71) Applicant: BRIDGELUX, INC., Fremont, CA (US)

(72) Inventors: Todd Farmer, Fremont, CA (US); Keith Scott, Fremont, CA (US)

(73) Assignee: BRIDGELUX, INC., Fremont, CA (US)

( * ) Notice: Subject to any disclaimer, the term of this patent is extended or adjusted under 35 U.S.C. 154(b) by 28 days.

(21) Appl. No.: 16/364,024

(22) Filed: Mar. 25, 2019

(65) Prior Publication Data

US 2019/0316763 A1 Oct. 17, 2019

Related U.S. Application Data

(63) Continuation of application No. 15/818,582, filed on Nov. 20, 2017, now Pat. No. 10,240,754, which is a (Continued)

(51) Int. Cl.
*F21V 17/00* (2006.01)
*F21V 29/70* (2015.01)
(Continued)

(52) U.S. Cl.
CPC ..... *F21V 17/005* (2013.01); *F21V 29/70* (2015.01); *F21V 31/005* (2013.01); *F21W 2111/02* (2013.01); *F21Y 2115/10* (2016.08)

(58) Field of Classification Search
CPC ..... F21V 17/005; F21V 29/70; F21V 31/005; F21Y 2115/10; F21W 2111/02
See application file for complete search history.

(56) References Cited

U.S. PATENT DOCUMENTS 7,600,890 B2 10/2009 Swantner et al.
9,822,952 B2 11/2017 Farmer et al.
(Continued)

FOREIGN PATENT DOCUMENTS

JP 2008192609 A 8/2008
TW M337864 U 8/2008
TW M364818 U 9/2009

OTHER PUBLICATIONS

Decision of Rejection dated Jan. 27, 2015 regarding Taiwan Application No. TW100141187.
(Continued)

*Primary Examiner* — Rajarshi Chakraborty
*Assistant Examiner* — Glenn D Zimmerman
(74) *Attorney, Agent, or Firm* — ArentFox Schiff LLP

(57) ABSTRACT

Apparatus providing beamforming and environmental protection for LED light sources. A lens apparatus is provided to protect an LED mounted on a substrate. The lens apparatus includes an alignment feature configured to align the LED to a selected position and a focusing region configured to form a selected beam pattern from light emitted from the LED when located at the selected position. The lens apparatus also includes a compression surface configured to compress the substrate to a heat sink to facilitate heat dissipation from the LED and a fastening feature configured to fasten the lens apparatus to the heat sink to provide an environmentally protective seal, so that when the lens apparatus is fastened to the heat sink the alignment feature aligns the LED to the selected position, the compression surface compresses the substrate to the heat sink, and the protective seal protects the LED from environmental conditions.

20 Claims, 3 Drawing Sheets

Related U.S. Application Data continuation of application No. 13/085,665, filed on Apr. 13, 2011, now Pat. No. 9,822,952.

(60) Provisional application No. 61/412,752, filed on Nov. 11, 2010.

(51) Int. Cl.

| | |
|---|---|
| ***F21V 31/00*** | (2006.01) |
| *F21Y 115/10* | (2016.01) |
| *F21W 111/02* | (2006.01) |

(56) References Cited

U.S. PATENT DOCUMENTS

2007/0056620 A1* 3/2007 Bahr ..... H01L 23/38 136/201
2008/0062697 A1 3/2008 Swantner et al.
2008/0273325 A1* 11/2008 Wilcox ..... F21V 25/00 362/240
2008/0278941 A1* 11/2008 Logan ..... F21V 15/01 362/234
2009/0180281 A1 7/2009 Ahland, III et al.
2009/0207617 A1* 8/2009 Merchant ..... F21S 41/192 362/294
2009/0237942 A1 9/2009 Lam et al.
2010/0072416 A1 3/2010 Fujioka et al.
2012/0043560 A1* 2/2012 Wu ..... F21K 9/00 257/88
2012/0075833 A1 3/2012 Le et al.
2013/0032768 A1* 2/2013 Arbell ..... C09K 11/883 252/582
2014/0126205 A1* 5/2014 Davis ..... F21V 31/03 362/244
2014/0126206 A1* 5/2014 Wilcox ..... G02B 19/0061 362/244
2014/0268763 A1* 9/2014 Duckworth ..... F21V 3/0625 362/244
2015/0001562 A1* 1/2015 Han ..... H01L 33/60 257/98
2017/0206813 A1* 7/2017 Huang ..... F21V 5/04
2018/0369523 A1* 12/2018 Pratt, Jr. ..... A61M 11/02
2019/0150319 A1* 5/2019 Leigh ..... H05K 7/20009 361/690

OTHER PUBLICATIONS

U.S. Appl. No. 61/412,752, filed Nov. 11, 2011.
International Preliminary Report on Patentability dated May 14, 2013 and Written Opinion dated Mar. 12, 2012 regarding PCT/US2011/060071.
International Search Report dated Mar. 12, 2012 regarding PCT/US2011/060071.
Japan Office Action dated Feb. 7, 2013 regarding Japan Application No. JP2011-540737.
Taiwan Office Action and Search Report dated May 22, 2014 regarding Taiwanese Patent Application No. 100141187.
Third Office Action dated Apr. 22, 2016 regarding Taiwan Application No. TW100141187, and English translation.

* cited by examiner

APPARATUS PROVIDING BEAMFORMING AND ENVIRONMENTAL PROTECTION FOR LED LIGHT SOURCES

CROSS-REFERENCE TO RELATED APPLICATIONS

This application is a continuation of U.S. patent application Ser. No. 15/818,582, filed Nov. 20, 2017, now U.S. Pat. No. 10,240,754, which is a continuation of U.S. patent application Ser. No. 13/085,665, filed Apr. 13, 2011, now U.S. Pat. No. 9,822,952, which claims benefit of U.S. Patent Application No. 61/412,752, filed Nov. 11, 2010, the disclosures of each of which are hereby incorporated by reference in their entireties.

BACKGROUND

Field

The present application relates generally to light emitting diodes, and more particularly, to apparatus providing beamforming and environmental protection for light emitting diode (LED) light sources.

Background

A light emitting diode comprises a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, and is referred to as an n-type or p-type semiconductor region, respectively.

In LED applications, an LED semiconductor chip includes an n-type semiconductor region and a p-type semiconductor region. A reverse electric field is created at the junction between the two regions, which causes the electrons and holes to move away from the junction to form an active region. When a forward voltage sufficient to overcome the reverse electric field is applied across the p-n junction, electrons and holes are forced into the active region and combine. When electrons combine with holes, they fall to lower energy levels and release energy in the form of light. The ability of LED semiconductors to emit light has allowed these semiconductors to be used in a variety of lighting devices. For example, LED semiconductors may be used in general lighting devices for interior applications or in street lighting for exterior applications.

When using LED semiconductors in lighting devices for exterior applications, it is generally necessary to provide environmental protection to prevent damage from exposure to moisture or other environmental conditions. For example, exterior LED lighting is typically designed to meet industry standard Ingress Protection (IP) ratings that specify various levels of environmental protection. For example, an IP rating normally has two (or three) numbers that specify a level of protection from solid objects, liquids, and/or mechanical impacts. Typically, LED lighting devices for exterior use are designed to satisfy IP-65/66/67 ratings.

Both interior and exterior LED lighting devices may utilize beamforming lenses to produce light having a particular beam pattern. For example, roadway lights are typically designed to meet Illuminating Engineering Society of North America (IESNA) or International Commission on Illumination (CIE) standards.

These standards specify illumination patterns for pole mounted roadway lights. To meet these requirements, an exterior LED lighting device may utilize one or more optical lenses and/or reflectors to distribute the light emitted from the LED semiconductor to produce light having a desired illumination pattern.

The application of LED semiconductors in lighting devices may also require the use of additional components to provide alignment or heat dissipation. For example, the precise alignment of the LED semiconductor may be needed to facilitate beamforming. Furthermore, high powered LED semiconductors used in exterior lighting applications often generate heat which needs to be dissipated. As a result, additional heat dissipating components may also be used in these devices.

Conventional LED devices for exterior use typically have separate components, parts, and/or assemblies which are combined to provide the beamforming, environmental protection, alignment, and heat dissipation functions described above. However, such devices typically comprise a large number of parts and/or mounting components. Unfortunately, this may result in LED devices that may be expensive, complicated to assemble/disassemble, and may be difficult to maintain and/or repair.

Accordingly, what is needed is a simple and efficient way to meet the beamforming and environmental protection requirements for exterior LED light sources and which overcomes the problems of excessive components, expense, and complicated assembly associated with conventional LED devices.

SUMMARY

In various implementations, an apparatus providing beamforming and environmental protection for LED light sources is provided. In one implementation, the apparatus comprises a beamforming lens that includes an alignment feature to align an LED, a compression surface to compress the LED to a heat sink, and an environmental protection feature to provide environmental protection. All these features are incorporated into an easy to mount apparatus requiring few mounting components. Thus, the apparatus provides a simple and efficient way to meet the beamforming and environmental protection requirements for an LED light source without the expense and/or excessive mounting components utilized in conventional light sources.

In an implementation, a lens apparatus is provided to protect an LED mounted on a substrate. The lens apparatus comprises an alignment feature configured to align the LED to a selected position and a focusing region configured to form a selected beam pattern from light emitted from the LED when located at the selected position. The lens apparatus also comprises a compression surface configured to compress the substrate to a heat sink to facilitate heat dissipation from the LED and a fastening feature configured to fasten the lens apparatus to the heat sink to provide an environmentally protective seal, so that when the lens apparatus is fastened to the heat sink the alignment feature aligns the LED to the selected position, the compression surface compresses the substrate to the heat sink, and the protective seal protects the LED from environmental conditions.

In an implementation, a lens apparatus is provided to protect an LED mounted on a substrate. The lens apparatus comprises means for aligning the LED to a selected position and means for forming a selected beam pattern from light emitted from the LED when located at the selected position. The lens apparatus also comprises means for compressing the substrate to a heat sink to facilitate heat dissipation from the LED and means for fastening the lens apparatus to the heat sink to provide an environmentally protective seal, so that when the lens apparatus is fastened to the heat sink the means for aligning aligns the LED to the selected position, the means for compressing compresses the substrate to the heat sink, and the protective seal protects the LED from environmental conditions.

In an implementation, an environmentally protective cover is provided to protect an LED from environmental conditions. The cover comprises an alignment feature configured to align the LED to a selected position, an optics region configured to form a selected beam pattern from light emitted from the LED when located at the selected position, and an environmentally protective seal that seals the cover to a heat sink, so that wherein when the cover is sealed to the heat sink the alignment feature aligns the LED to the selected position and the protective seal protects the LED from environmental conditions.

It is understood that other aspects of the present invention will become readily apparent to those skilled in the art from the following detailed description. As will be realized, the present invention includes other and different aspects and its several details are capable of modification in various other respects, all without departing from the spirit and scope of the present invention. Accordingly, the Drawings and the Description are to be regarded as illustrative in nature and not as restrictive.

BRIEF DESCRIPTION OF THE DRAWINGS

The foregoing aspects described herein will become more readily apparent by reference to the following Description when taken in conjunction with the accompanying drawings wherein.

DESCRIPTION

Figure 1:
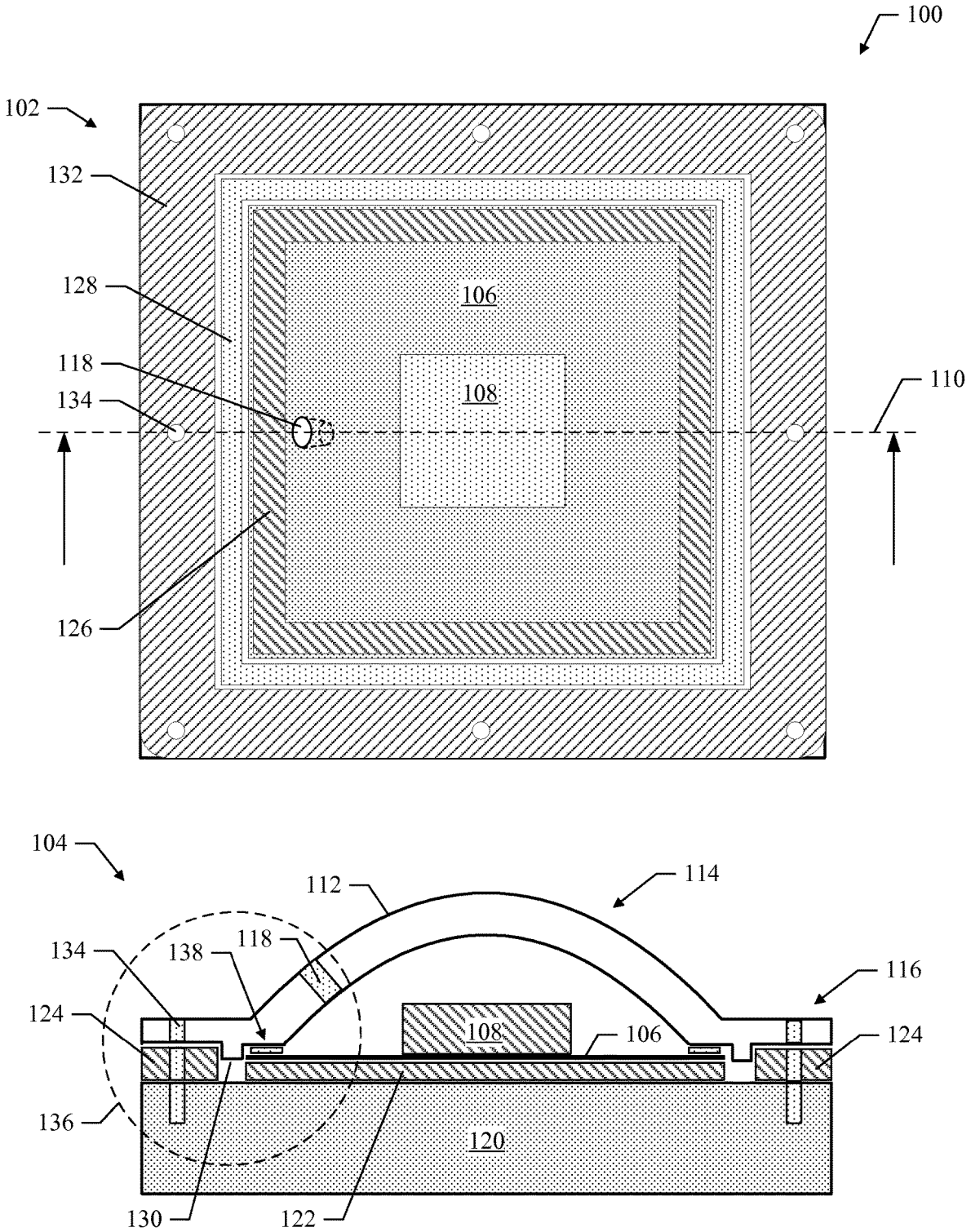
FIG. 1 shows top and cross-sectional views of an exemplary apparatus for providing beamforming and environmental protection for LED light sources.

The present invention is described more fully hereinafter with reference to the accompanying Drawings, in which various aspects of the present invention are shown. This invention may, however, be embodied in many different forms and should not be construed as limited to the various aspects presented throughout this disclosure. Rather, these aspects are provided so that this disclosure will be complete enough to provide a thorough understanding of the present invention to those skilled in the art. The various aspects of the present invention illustrated in the drawings may not be drawn to scale. Accordingly, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes may not be intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the Drawings. By way of example, if an apparatus in the Drawings is turned over, elements described as being on the "lower" side of other elements would then be oriented on the "upper" sides of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this disclosure.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items It will be understood that although the terms "first" and "second" may be used herein to describe various regions, layers and/or sections, these regions, layers and/or sections should not be limited by these terms. These terms are only used to distinguish one region, layer or section from another region, layer or section. Thus, a first region, layer or section discussed below could be termed a second region, layer or section, and similarly, a second region, layer or section may be termed a first region, layer or section without departing from the teachings of the present invention.

FIG. 1 shows a top view 102 and a cross-sectional view 104 of an exemplary apparatus 100 for providing beamforming and environmental protection for LED light sources. For example, the apparatus 100 is suitable for use in an external lighting device, such as a roadway light. In one implementation, the apparatus 100 is dimensioned to be 5 inches wide by 5 inches long by 2 inches tall.

Referring to the top view 102, a substrate 106 is shown that comprises a LED semiconductor 108 mounted thereon. The substrate 106 comprises ceramic or other suitable material. The LED 108 comprises an LED semiconductor device suitable for external lighting applications. It should be noted that although only one LED semiconductor is shown in FIG. 1, the substrate 106 may be configured to support any number of LED semiconductors.

The cross-sectional view 104 shows the apparatus 100 from a perspective taken at cross-section indicator 110. As illustrated in the view 104, the apparatus 100 comprises a lens 112. The lens 112 may also be referred to as an environmentally protective cover, cap, or LED protector. The lens 112 may be comprised of one or more materials, namely; acrylic, glass, plastic, crystal, or a polymer. In one implementation, the lens 112 comprises a clear acrylic which can be seen in the cross-sectional view 104 but is not easily detected in the top view 102. The lens 112 comprises a focusing portion or optics region, shown generally at 114, and a mounting portion, shown generally at 116.

The focusing portion 114 of the lens 112 operates to form a particular beam pattern from the light emitted from the LED 108. For example, the focusing portion 114 comprises any suitable optics or optical material that functions to redistribute incoming light from the LED 108 to produce light having a desired pattern. For example, the beam pattern may be any IESNA or CIE type beam pattern. In another implementation, the beam pattern is any user defined beam pattern such as a round, non-round, or elliptical pattern or a pattern having any other geometric or user defined shape, for instance, stars, triangles or half circles typically used in entertainment lighting. However, in other implementations, the lens 112 is transparent or translucent and the resulting beam pattern replicates the light emission pattern of light emitted from the LED 108. Another feature of the lens 112 is conduit 118 which provides a path that can be used to route electrical connections to the LED 108 to provide power, ground, and/or other electrical signals. Also shown in the view 104 are heat sink 120, thermal interface material 122 and gasket 124.

Referring again to the top view 102, several regions are illustrated. For example, a compression region 126 is shown. The compression region 126 represents a region where the lens 112 comes into contact with the substrate 106 and operates to compress the substrate 106 onto the heat sink 120.

Another region shown in the top view 102 is an alignment region 128. The alignment region 128 represents a region comprising a flange 130 (shown more clearly in the view 104) which operates to capture the substrate 106 into a particular location or position. The flange 130 is described in more detail in another section of this document.

Another region shown in the top view 102 is an environmental protection region 132. The environmental protection region 132 represents a region where the gasket 124, O-ring or other material is captured between the lens 112 and the heat sink 120. This operates to protect the LED 108 from environmental conditions, such as exposure to moisture or liquids. In this example, a fastening feature comprising several mounting holes 134 are provided to allow the lens 112 to be fastened to the heat sink 120.

Referring again to cross-sectional view 104, a region 136 is shown. The region 136 includes the compression region 126, the alignment region 128, and the environment protection region 132. When the lens 112 is fastened to the heat sink 120, a compression surface 138 of the compression region 126 compresses the substrate 106 and thermal interface material 122 to the heat sink 120, while the flange 130 aligns the substrate 106 (and LED 108) into the desired position and the gasket 124 provides environmental protection to protect the LED 108 from environmental conditions. The features of the lens 112 contained in the region 136 are described in more detail in another section of this document.

As a result, the lens 112 provides a simple and efficient way to meet the beamforming and environmental protection requirements for an exterior LED light source without the expense and complicated mounting components utilized in conventional light sources. To summarize, the lens 112 operates to provide at least the following four functions.

1. Beamforming—The focusing region 114 allows any beam pattern, such as IESNA (types 1-5) beam patterns, to be produced from light emitted from a light source comprising one or more semiconductor devices.
2. Environmental Protection—Region 132 and gasket 124 provide environmental protection, such as IP 65/66/67/68 ratings, to protect the semiconductor light source from environmental conditions.
3. Simplified Assembly—The alignment region 128 and the compression region 126 enable a fastening feature (comprising mount holes 134) to be used to fasten the lens to a heat sink and thereby assure environmental protection, alignment of the semiconductor light source, and compression of the semiconductor light source to the heat sink for heat dissipation.
4. Electrical Connection—The conduit 118 provides an environmentally protected wiring conduit to allow power, ground and/or signal conductors to be routed to the semiconductor light source.

Figure 2:
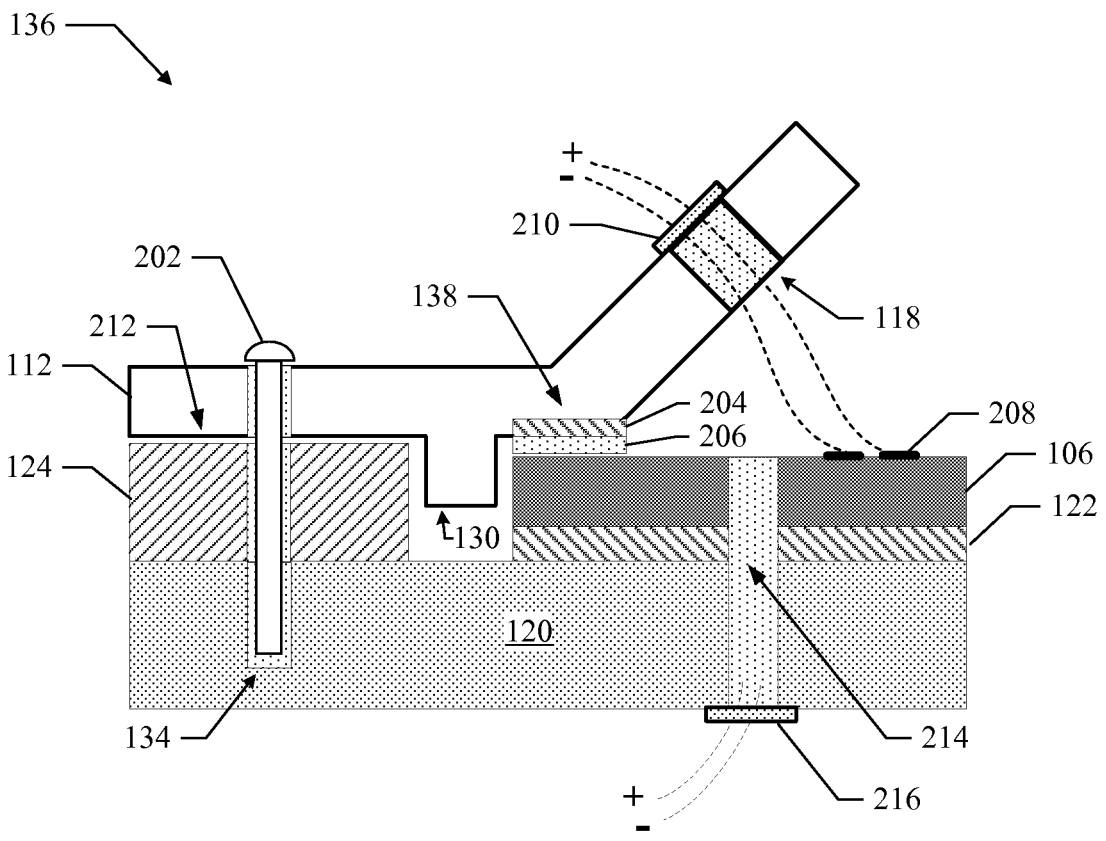
FIG. 2 shows a detailed view of the apparatus illustrated in FIG. 1.

FIG. 2 shows a detailed view of the region 136 of the apparatus 100 shown in FIG. 1. The detailed view 136 illustrates the arrangement of the lens 112, heat sink 120, and substrate 106. The detailed view 136 also illustrates the features of the lens 112 which provide beamforming, environmental protection, simplified assembly, and electrical connections.

When assembled, the lens 112 is fastened to the heat sink 120 using the fastening feature. For example, the fastening feature comprises a fastener, such as a screw, pin, or clip 202 that is installed in the mounting hole 134. In another implementation, the fastening feature comprises a latch or a snap-closure, which utilize the mounting holes 134 to fasten the lens 112 to the heat sink 120. When fastened together the lens 112 and the heat sink 120 compress the gasket 124 to form an environmentally protective seal to protect the semiconductor light source from exposure to moisture or other harmful environmental conditions. For example, the lens 112 comprises a protection surface 212 that compresses the gasket 124 or O-ring to the heat sink 120. The gasket 124 comprises an elastomer designed to provide a moisture barrier when compressed.

As illustrated, the lens 112 comprises the flange 130 which operates to surround and capture the substrate 106 into a particular location or position with respect to the lens 112 thereby providing a mechanism for aligning the location of the semiconductor light source to achieve the desired beam pattern. For example, the LED 108 is aligned into a selected position by aligning the substrate 106. When the LED 108 is aligned, its emitted light will strike the focusing portion 114 of the lens 112 to produce the desired beam pattern. In another implementation, the flange 130 may not completely surround the substrate 106 but may form several smaller flanges or teeth that are spaced around the substrate and operate to capture the substrate. In another implementation, the flange 130 is implemented as one or more alignment pins that align with alignment holes in the substrate 106 thereby aligning the substrate 106 when the alignment pins penetrate the substrate alignment holes as the lens 112 is fastened to the heat sink 120.

Therefore, although the alignment of the substrate 106 and ultimately the semiconductor light source is performed by the flange 130, the alignment of the substrate 106 may also be achieved using alignment teeth, pins or other alignment mechanism that performs alignment of the substrate 106 when the lens 112 is fastened to the heat sink 120.

The compression surface 138 optionally comprises a thermal isolation material 204 and a rigid layer 206. When the lens 112 is fastened to the heat sink 120, the rigid layer 206 and the isolation material 204 compress against the substrate 106 to compress the substrate 106 and thermal interface material 122 against the heat sink 120. This facilitates dissipation of heat generated by the semiconductor light source into the heat sink 120. The rigid layer 206 comprises metal or other material that can withstand compression onto the substrate 106 without damage. The rigid layer 206 contacts the substrate 106 along the substrate's perimeter. In one implementation, the rigid layer 206 contacts the substrate 106 along its entire perimeter. In another implementation, the rigid layer 206 contacts only selected regions of the substrate 106 located along its perimeter. The rigid layer 206 operates to compress the substrate 106 to the heat sink 120 and so it is possible that the rigid layer 206 have any desired sized or shaped regions to accomplish this function.

Between the lens 112 and the rigid layer 206 is the thermal isolation material 204. The thermal isolation material 204 comprises any material that can protect the lens 112 from heat that may be experienced by the rigid layer 206. For example, as the rigid layer 206 compresses the substrate 106 to the heat sink 120, heat will flow from the substrate 106 to the rigid layer 206. If the rigid layer 206 is composed of metal then the heat transfer may cause the temperature of the metal to reach a level that may damage the lens 112. The thermal isolation material 204 operates to protect the lens 112 from any heat that builds up in the rigid layer 206.

To facilitate the transfer of heat, the thermal transfer material 122 is provided between the substrate 106 and the heat sink 120. The thermal transfer material 122 may comprise any suitable material designed for this purpose.

The lens 112 also comprises the conduit 118, which provides a path for electrical connections to the semiconductor light source. For example, power (+) and ground (−) wires can pass through the conduit 118 and attach to the substrate 106 at conductive pads 208 to provide power to the semiconductor light source. In one implementation, an environmentally protective connector 210 is mounted to the conduit 118 and operates to prevent moisture or gas from penetrating the region inside the lens 112. The connector 210 may be any connector suitable for this purpose.

In an alternative implementation, a conduit 214 through the heat sink 120 is provided. The conduit 214 allows power (+) and ground (—) wires to pass to the substrate 106 to provide power to the semiconductor light source. An environmentally protective connector 216 is also provided.

Figure 3:
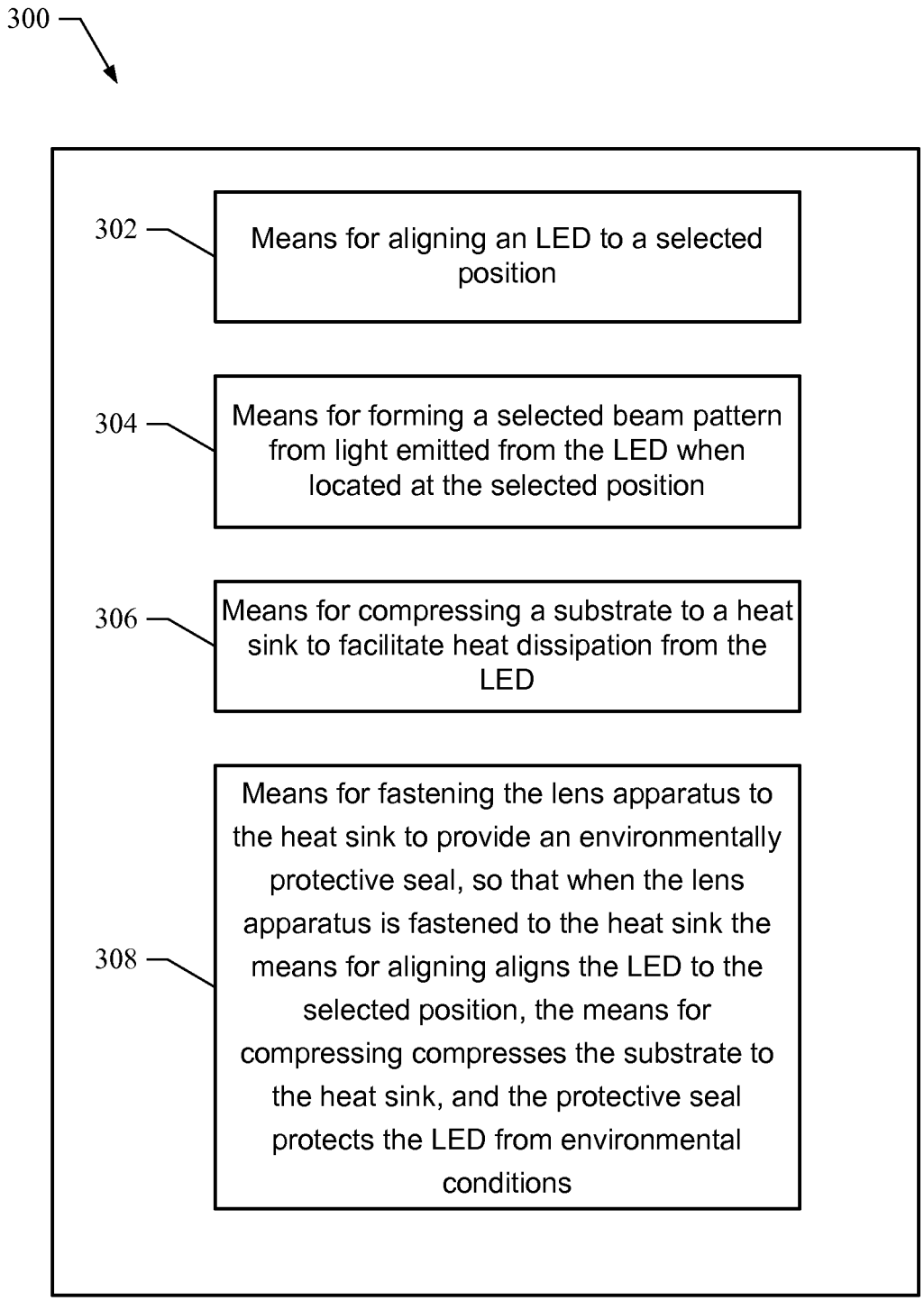
FIG. 3 shows an exemplary apparatus for providing beamforming and environmental protection for LED light sources.

FIG. 3 shows an exemplary apparatus 300 for providing beamforming and environmental protection for LED light sources. For example, the apparatus 300 may be used as the lens apparatus 112 shown in FIG. 1.

The apparatus 300 comprises means (302) for aligning an LED to a selected position. For example, in one implementation, means 302 comprises the flange 130.

The apparatus 300 also comprises means (304) for forming a selected beam pattern from light emitted from the LED when located at the selected position. For example, in one implementation, the means 304 comprises the focusing portion 114.

The apparatus 300 also comprises means (306) for compressing a substrate to a heat sink to facilitate heat dissipation from the LED. For example, in one implementation, the means 306 comprises the compression surface 138.

The apparatus 300 also comprises means (308) for fastening the lens apparatus to the heat sink to provide an environmentally protective seal, so that when the lens apparatus is fastened to the heat sink the means for aligning aligns the LED to the selected position, the means for compressing compresses the substrate to the heat sink, and the protective seal protects the LED from environmental conditions. For example, in one implementation, the means 308 comprises the protection surface 212 and gasket 124.

Thus, the apparatus 300 operates to provide beamforming and environmental protection for LED light sources.

The various aspects of this disclosure are provided to enable one of ordinary skill in the art to practice the present invention. Various modifications to aspects presented throughout this disclosure will be readily apparent to those skilled in the art, and the concepts disclosed herein may be extended to other applications. Thus, the claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skill in the art are expressly incorporated herein by reference and are intended to be encompassed by the claims.

Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

Accordingly, while aspects of an LED apparatus for beamforming and environmental protection for LED lighting devices have been illustrated and described herein, it will be appreciated that various changes can be made to the aspects without departing from their spirit or essential characteristics. Therefore, the disclosures and descriptions herein are intended to be illustrative, but not limiting, of the scope of the invention, which is set forth in the following claims.

What is claimed is:

1. A lens apparatus for protecting a light emitting diode (LED) mounted on a substrate, the lens apparatus comprising:

a lens having a mounting structure configured to mount the lens to a base and an optics region configured to focus light emitted from the LED;

an alignment feature on the mounting structure and that is configured to align the LED relative to the lens when the lens is mounted to the base; and a compression surface configured to compress the substrate to the base, such that the lens apparatus is configured as an environmentally protective seal for the LED, wherein a portion of the compression surface comprises only a thermal isolation layer and a rigid layer, the rigid layer being directly coupled to the thermal isolation layer and the substrate, and wherein the alignment feature comprises one of a projection extending from the mounting structure or a hole extending in the mounting structure.

2. The lens apparatus according to claim 1, wherein the alignment feature comprises an indentation flange extending from the mounting portion of the lens adjacent to the compression surface.

3. The lens apparatus according to claim 1, wherein the base comprises a heat sink and the compression surface is configured to compress the substrate to the heat sink, such that the lens apparatus is configured as the environmentally protective seal to protect the LED from environmental conditions.

4. The lens apparatus according to claim 1, wherein the substrate is captured within the projection with the LED aligned to face the optics region of the lens.

5. The lens apparatus according to claim 1, further comprising a fastening feature including at least one mounting hole configured to receive at least one of a screw, pin, and clip to fasten the lens apparatus to the base.

6. The lens apparatus according to claim 3, further comprising a thermal interface coupling the substrate to the heat sink.

7. The lens apparatus according to claim 5, wherein the fastening feature further comprises a protection surface configured to compress at least one of a gasket and an O-ring between the lens apparatus and the base.

8. A lens for protecting a light emitting diode (LED) mounted on a substrate, the lens comprising:

an optics region configured to focus light emitted from the LED;

an alignment feature comprising one of a projection and a hole and configured to align the LED relative to the optics region; and a compression surface configured to compress the substrate to a base, such that the lens protectively seals the LED from environmental conditions, wherein a portion of the compression surface comprises only a thermal isolation layer and a rigid layer, the rigid layer being directly coupled to the thermal isolation layer and the substrate.

9. The lens according to claim 8, wherein the alignment feature comprises an indentation flange extending from a mounting portion of the lens adjacent to the compression surface.

10. The lens according to claim 8, wherein the base comprises a heat sink and the compression surface is configured to compress the substrate to the heat sink, such that the lens apparatus is configured as the environmentally protective seal to protect the LED from environmental conditions.

11. The lens according to claim 8, wherein the alignment feature extends from a mounting portion of the lens to align the LED relative to the lens.

12. The lens according to claim 8, wherein the substrate is captured within the projection or the hole the LED aligned to face the optics region of the lens.

13. The lens according to claim 8, further comprising a fastening feature including at least one mounting hole configured to receive at least one of a screw, pin, and clip to fasten the lens apparatus to the base.

14. The lens according to claim 10, further comprising a thermal interface coupling the substrate to the heat sink, such that lens apparatus is configured as an environmentally protective seal to protect the LED from the environmental conditions.

15. The lens according to claim 13, wherein the fastening feature further comprises a protection surface configured to compress at least one of a gasket and an O-ring between the lens apparatus and the base.

16. An environmentally protective cover for protecting a light emitting diode (LED) mounted on a substrate from environmental conditions, the cover comprising:

an alignment feature disposed on the cover and configured to align the LED to a position relative to the cover;

a compression surface on the cover and configured to compress the substrate to a base, wherein a portion of the compression surface comprises only a thermal isolation layer and a rigid layer directly, the rigid layer being coupled to the thermal isolation layer and the substrate; and an environmentally protective seal that seals the cover to the base, such that the alignment feature captures the substrate to align the LED to the position relative to the cover and protectively seal the LED from the environmental conditions, wherein the alignment feature comprises one of a projection extending from a mounting structure of the cover or a hole extending in the mounting structure of the cover.

17. The environmentally protective cover according to claim 16, wherein the base comprises a heat sink configured to dissipate heat from the LED when the cover is sealed to the heat sink.

18. The environmentally protective cover according to claim 16, further comprising an optics region configured to form a selected beam pattern from light emitted from the LED when located at the position relative to the cover.

19. The environmentally protective cover according to claim 17, further comprising a fastening feature including at least one mounting hole configured to receive at least one of a screw, pin, and clip to fasten the lens apparatus to the heat sink.

20. The environmentally protective cover according to claim 18, wherein the substrate is captured within the projection comprising at least one flange with the LED aligned to face the optics region.

* * * * *